US009726158B2

(12) United States Patent
Iwanaji

(10) Patent No.: US 9,726,158 B2
(45) Date of Patent: Aug. 8, 2017

(54) SWASH PLATE PUMP HAVING CONTROL PINS IN SERIES

(71) Applicant: KAYABA INDUSTRY CO., LTD., Minato-ku, Tokyo (JP)

(72) Inventor: Tetsuya Iwanaji, Kanagawa (JP)

(73) Assignee: KYB Corporation, Tokyo (JP)

( * ) Notice: Subject to any disclaimer, the term of this patent is extended or adjusted under 35 U.S.C. 154(b) by 260 days.

(21) Appl. No.: 14/360,335

(22) PCT Filed: Nov. 21, 2012

(86) PCT No.: PCT/JP2012/080162

§ 371 (c)(1),
(2) Date: May 23, 2014

(87) PCT Pub. No.: WO2013/077355

PCT Pub. Date: May 30, 2013

(65) Prior Publication Data

US 2014/0328700 A1 Nov. 6, 2014

(30) Foreign Application Priority Data

Nov. 25, 2011 (JP) ..... 2011-257643

(51) Int. Cl.
*F04B 1/29* (2006.01)
*F04B 1/14* (2006.01)
(Continued)

(52) U.S. Cl.
CPC ..... *F04B 1/295* (2013.01); *F04B 1/146* (2013.01); *F04B 1/2078* (2013.01); *F04B 1/324* (2013.01);
(Continued)

(58) Field of Classification Search
CPC .. F04B 1/295; F04B 1/146; F04B 1/22; F04B 1/141; F04B 1/148; F04B 1/26;
(Continued)

(56) References Cited

U.S. PATENT DOCUMENTS 3,753,627 A * 8/1973 Ward ..... F04B 1/324 417/213
4,061,443 A * 12/1977 Black ..... F04B 27/1072 184/6.17
(Continued)

FOREIGN PATENT DOCUMENTS

EP 2 177 759 * 4/2010 ..... F04B 1/22
JP 01-267367 * 10/1989 ..... F04B 1/20
(Continued)

OTHER PUBLICATIONS

International Search Report mailed Feb. 12, 2013, in corresponding International Application No. PCT/JP2012/080162.

*Primary Examiner* — Bryan Lettman
*Assistant Examiner* — Timothy Solak
(74) *Attorney, Agent, or Firm* — Hauptman Ham, LLP

(57) ABSTRACT

A swash plate type piston pump includes a plurality of pistons, a cylinder block including a plurality of cylinders for housing the pistons, a swash plate for reciprocating the pistons to expand and contract volume chambers of the cylinders with the rotation of the cylinder block, a biasing mechanism for biasing the swash plate in a direction to increase a tilting angle, a first control pin for driving the swash plate in a direction to reduce the tilting angle according to a first load pressure, and a second control pin for driving the swash plate in a direction to reduce the tilting angle according to a second load pressure. The first and second control pins are connected in series.

12 Claims, 4 Drawing Sheets

(51) Int. Cl.

| | |
|---|---|
| ***F04B 1/32*** | (2006.01) |
| ***F04B 1/20*** | (2006.01) |
| ***F04B 23/10*** | (2006.01) |
| ***F04B 39/12*** | (2006.01) |
| ***F04B 27/08*** | (2006.01) |
| ***F04B 27/22*** | (2006.01) |
| ***F04B 49/00*** | (2006.01) |
| ***F04B 49/12*** | (2006.01) |
| ***F04B 49/08*** | (2006.01) |

(52) U.S. Cl.
CPC ..... *F04B 23/10* (2013.01); *F04B 27/086* (2013.01); *F04B 27/0873* (2013.01); *F04B 27/22* (2013.01); *F04B 39/12* (2013.01); *F04B 49/002* (2013.01); *F04B 49/08* (2013.01); *F04B 49/12* (2013.01)

(58) Field of Classification Search
CPC .. F04B 1/28; F04B 23/04; F04B 23/10; F04B 39/12; F04B 1/20; F04B 1/2014; F04B 1/2078; F04B 1/30; F04B 1/32; F04B 27/08; F04B 27/0804; F04B 27/0821; F04B 27/086; F04B 27/0873; F04B 27/14; F04B 27/20; F04B 27/22; F04B 49/002; F04B 49/12
See application file for complete search history.

(56) References Cited

U.S. PATENT DOCUMENTS

| | | | | |
|---|---|---|---|---|
| 4,157,233 | A * | 6/1979 | Horiuchi | F04B 49/08 417/218 |
| 6,662,558 | B1 * | 12/2003 | Nelson | F04B 1/28 60/443 |
| 2009/0047153 | A1 * | 2/2009 | Best | E21B 43/126 417/415 |
| 2011/0113954 | A1 * | 5/2011 | Mori | F04B 1/128 91/505 |

FOREIGN PATENT DOCUMENTS

| | | | |
|---|---|---|---|
| JP | 01-267367 | A | 10/1989 |
| JP | 2001-003853 | A | 1/2001 |
| JP | 2002-202063 | A | 7/2002 |

* cited by examiner

SWASH PLATE PUMP HAVING CONTROL PINS IN SERIES

RELATED APPLICATIONS

The present application is a National Phase of International Application Number PCT/JP2012/080162, filed on Nov. 21, 2012, which claims priority to Japanese Application Number 2011-257643, filed on Nov. 25, 2011.

TECHNICAL FIELD

The present invention relates to a swash plate type piston pump capable of changing a discharge capacity according to a load pressure.

BACKGROUND ART

In an operating machine such as a mini shovel, a swash plate type piston pump is driven by an engine. A hydraulic actuator performing various operations is driven by working oil discharged from the piston pump. Power of the swash plate type piston pump is controlled to be substantially constant even if a load pressure of the hydraulic actuator changes. This suppresses a rotational fluctuation of the engine.

JP2001-3853A and JP2002-202063A disclose a swash plate type piston pump provided with control pins (control piston, tilting actuator) which operate according to a load pressure, and configured to tilt a swash plate by these control pins.

SUMMARY OF INVENTION

An operating machine such as a mini shovel is equipped with an air conditioning device (air conditioner). When an engine drives a compressor provided in the air conditioning device, the number of elements which consume power of the engine increases. This necessitates a control pin for tilting a swash plate according to the operation of the air conditioning device. Thus, the number of control pins increases, leading to the enlargement of a swash plate type piston pump.

It is an object of the present invention to suppress the enlargement of a swash plate type piston pump which operates according to a plurality of load pressures.

According to one aspect of the present invention, a swash plate type piston pump capable of changing a discharge capacity according to a load pressure is provided. The swash plate type piston pump includes a plurality of pistons, a cylinder block including a plurality of cylinders for housing the pistons, a swash plate for reciprocating the pistons to expand and contract volume chambers of the cylinders with the rotation of the cylinder block, a biasing mechanism for biasing the swash plate in a direction to increase a tilting angle, a first control pin for driving the swash plate in a direction to reduce the tilting angle according to a first load pressure, and a second control pin for driving the swash plate in a direction to reduce the tilting angle according to a second load pressure. The first and second control pins are connected in series.

Embodiments of the present invention and advantages thereof are described in detail below with reference to the accompanying drawings.

DESCRIPTION OF EMBODIMENTS

Hereinafter, an embodiment of the present invention is described based on the drawings.

Figure 1:
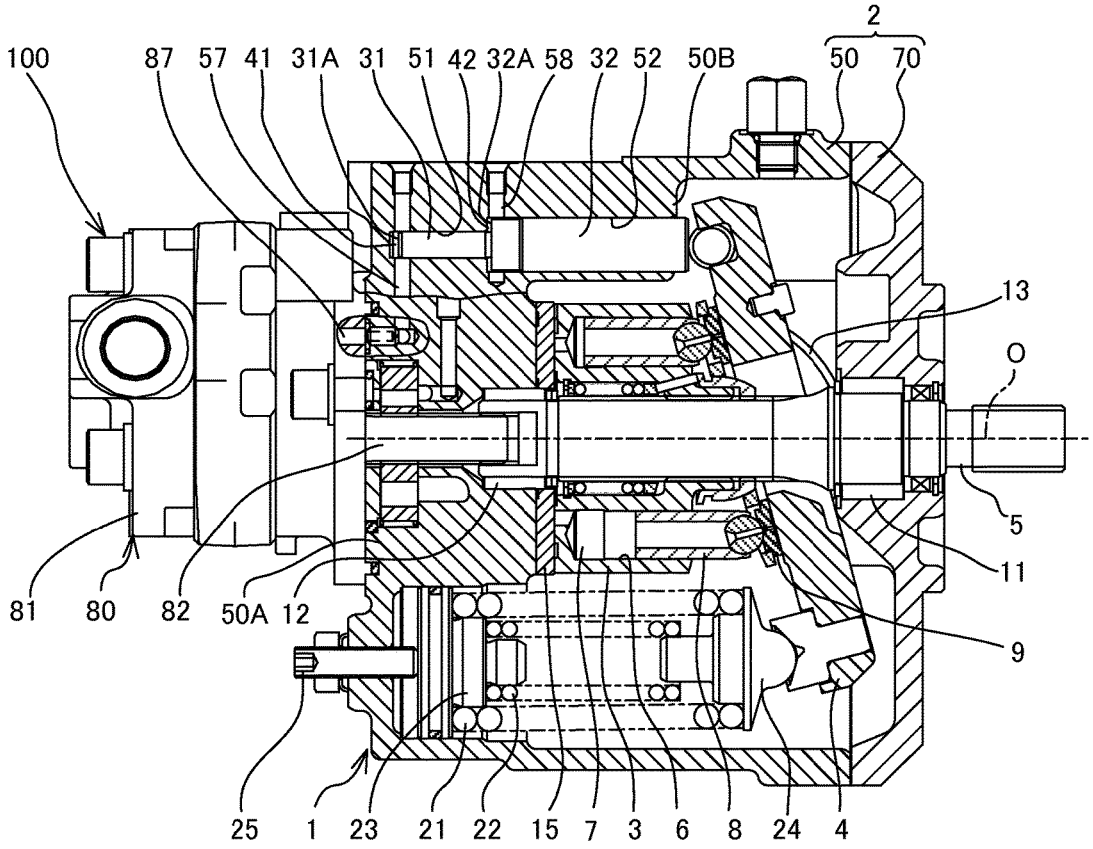
FIG. 1 is a sectional view of a piston pump according to an embodiment of the present invention.
Figure 2:
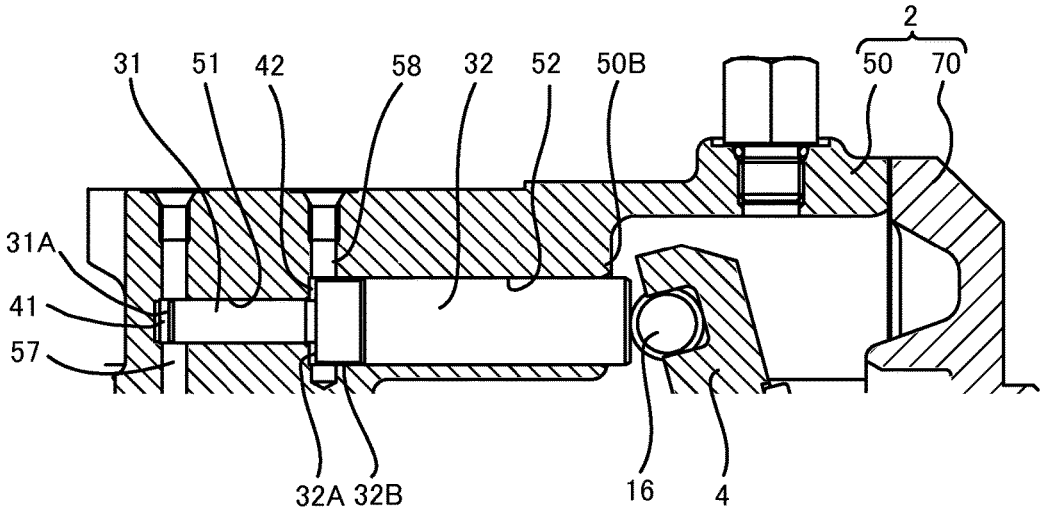
FIG. 2 is a sectional view enlargedly showing a part of FIG. 1.

FIG. 1 is a sectional view of a piston pump according to the embodiment of the present invention. FIG. 2 is a sectional view enlargedly showing a part of FIG. 1. A pump unit 100 is installed in an operating machine such as a mini shovel and driven by an unillustrated engine. An unillustrated air conditioning device (air conditioner) is installed in this operating machine and an unillustrated compressor provided in this air conditioning device is driven by the engine.

Power of the engine is consumed in a main piston pump 1, a sub piston pump 80 and the compressor provided in the air conditioning device. As described later, the main piston pump 1 keeps the total value of the consumed power substantially constant by changing a discharge capacity (displacement volume) according to a change in the power consumed by these.

The main swash plate type piston pump 1 and the sub swash plate piston pump 80 are provided side by side on an axis of rotation O of the pump unit 100.

An unillustrated cylinder block, a plurality of pistons which reciprocate relative to the cylinder block, and an swash plate which is followed by the pistons are housed in a casing 81 of the sub piston pump 80. The rotation of the engine is transmitted to the cylinder block via shafts 5 and 82. When the cylinder block rotates, the pistons reciprocate relative to the cylinder block. This causes working fluid (working oil) from an unillustrated tank to be sucked into volume chambers defined by the pistons via a piping. Further, the working fluid discharged from the volume chambers to a discharge port is introduced to fluid pressure actuators (hydraulic cylinder, hydraulic motor) via the piping.

A cylinder block 3, a plurality of pistons 8 which reciprocate relative to the cylinder block 3, and a swash plate 4 which is followed by the pistons 8 are housed in a casing 2 of the main piston pump 1. Rotation is transmitted from the engine to the cylinder block 3 via the shaft 5. When the cylinder block 3 rotates, the pistons 8 reciprocate relative to the cylinder block 3. This causes the working fluid from the unillustrated tank to be sucked into volume chambers 7 defined by the pistons 8 via the piping. Further, the working fluid discharged from the volume chambers 7 to the discharge port is introduced to the fluid pressure actuators (hydraulic cylinder, hydraulic motor) via the piping.

The configuration of the main piston pump 1 is described below.

The casing 2 includes a pump housing 50 in the form of a bottomed tube and a pump cover 70 in the form of a lid. The cylinder block 3, the swash plate 4 and the like are housed inside these. The pump cover 70 is fastened to the pump housing 50 by a plurality of unillustrated bolts.

The cylinder block 3 is driven and rotated via the shaft 5. One end of the shaft 5 extends outward from the pump cover 70 and the rotation of the engine provided as a drive source is transmitted thereto. The shaft 5 is supported on the pump housing 50 via a bearing 12 and supported on the pump cover 70 via a bearing 11.

A plurality of cylinders 6 are arranged to the cylinder block 3 substantially in parallel to the axis of rotation O. The cylinders 6 are provided side by side at constant intervals substantially on the same circumference centered on the axis of rotation O.

The piston 8 is slidably inserted into each cylinder 6 and the volume chamber 7 is defined between the cylinder 6 and the piston 8. One end of the piston 8 projects from the cylinder block 3 and is supported via a shoe 9 held in contact with the swash plate 4. When the cylinder block 3 rotates, each piston 8 reciprocates following the swash plate 4, thereby expanding and contracting the volume chamber 7.

The pump housing 50 includes a bottom part 50A formed with passages along which the working fluid is supplied to and discharged from the volume chambers 7 and a tubular side wall part 50B surrounding the cylinder block 3 and the like.

A port plate 15 with which the cylinder block 3 slides in contact is provided in the bottom part 50A of the pump housing 50. The port plate 15 is formed with unillustrated intake port and discharge port communicating with each volume chamber 7. The bottom part 50A of the pump housing 50 is formed with unillustrated supply/discharge passages communicating with the intake port and the discharge port.

In the piston pump 1, each piston 8 makes one reciprocating movement in the cylinder 6 per one rotation of the cylinder block 3. In an intake stroke during which the volume chambers 7 of the cylinders 6 expand, the working fluid in the tank is sucked into each volume chamber 7 from the intake port via the piping and the passage in the pump housing 50. Further, in a discharge stroke during which the volume chambers 7 of the cylinders 6 contract, the working fluid discharged from each volume chamber 7 to the discharge port is introduced to the fluid pressure actuators via the passage in the pump housing 50 and the piping.

To make the discharge capacity of the piston pump 1 variable, the swash plate 4 is tiltably supported on the pump cover 70 via a bearing 13. The bearing 13 is provided in the pump cover 70.

As a biasing mechanism for biasing the swash plate 4 in a direction to increase a tilting angle, a first tilt spring 21 and a second tilt spring 22 are interposed between the pump housing 50 and the swash plate 4.

The coiled first and second tilt springs 21, 22 are interposed between a retainer 23 mounted in the pump housing 50 and a retainer 24 attached to the swash plate 4. The retainer 23 is displaceable by a working fluid pressure. An initial position of the retainer 23 is adjusted via an adjuster 25.

The first and second tilt springs 21, 22 have different winding diameters of a wire material, and the second tilt spring 22 having a smaller winding diameter is arranged inside the first tilt spring 21 having a larger winding diameter. When the tilting angle of the swash plate 4 becomes maximum as shown in FIG. 1, the first tilt spring 21 having a larger winding diameter is interposed in a compressed state between the retainers 23 and 24. On the other hand, the second tilt spring 22 having a smaller winding diameter is interposed in a state where one end is separated from the retainer 24. This causes only the first tilt spring 21 to be compressed when the swash plate 4 is tilted more than a predetermined angle. Further, when the swash plate 4 is tilted at the predetermined angle or less, both ends of the second tilt spring 22 are held in contact with the retainers 23, 24 and the second tilt spring 22 is compressed in addition to the first tilt spring 21. Thus, a spring force applied to the swash plate 4 increases in a stepwise manner according to the tilting angle of the swash plate.

Three control pins are provided which control the discharge capacity of the piston pump 1 by pushing the swash plate 4 against spring forces of the first and second tilt springs 21, 22. The three control pins are a main control pin (not shown) to which a discharge pressure of the main piston pump 1 is introduced as a load pressure, a first control pin 31 to which a discharge pressure of the sub piston pump 80 is introduced as a first load pressure and a second control pin 32 to which a pilot pressure is introduced as a second load pressure when the air conditioning device is operated.

The main control pin is arranged in parallel to the first and second control pins 31, 32 and provided near the first and second control pins 31, 32.

The cylindrical main control pin is slidably inserted into a main cylinder formed in the pump housing 50 and one end thereof is held in contact with the swash plate 4. An unillustrated main pressure chamber is defined between the main cylinder and the main control pin. The discharge pressure of the piston pump 1 is introduced to the main pressure chamber. The main control pin pushes the swash plate 4 by the discharge pressure of the piston pump 1 received by an end surface thereof. The swash plate 4 is driven in a direction to reduce the tilting angle by being pushed against the first and second tilt springs 21, 22 by the main control pin.

The first and second control pins 31, 32 are formed into cylindrical shapes having different outer diameters. The outer diameter of the first control pin 31 is smaller than that of the second control pin 32.

The first and second control pins 31, 32 are arranged in series on the same axis and connected to each other. The first and second control pins 31, 32 may be integrally formed or may be separately formed and connected via a connecting member.

Since the first and second control pins 31, 32 are arranged in series, a space in a circumferential direction for housing the first and second control pins 31, 32 can be made smaller as compared with a structure in which the first and second control pins are arranged in parallel. Thus, the pump housing 50 can be made smaller, wherefore mountability of the pump unit 100 into the operating machine can be improved.

A small-diameter hole 51 and a large-diameter hole 52 into which the first and second control pins 31, 32 are respectively slidably inserted are respectively formed in the side wall part 50B of the pump housing 50 by machining. Since a part of the pump housing 50 facing the swash plate 4 is open in a state before the pump cover 70 is mounted, the small-diameter hole 51 and the large-diameter hole 52 can be respectively formed by machining.

A first pressure chamber 41 is defined between the small-diameter hole 51 and the first control pin 31. An end surface of the first control pin 31 is a pressure receiving surface 31A facing the first pressure chamber 41.

A through hole 57 which is open on the first pressure chamber 41 is formed in the side wall part 50B of the pump housing 50. The discharge pressure of the sub piston pump 80 is introduced to the first pressure chamber 41 via through holes 87, 57. The first control pin 31 is moved rightward in FIG. 1 by the discharge pressure of the piston pump 80 received by the pressure receiving surface 31A.

A second pressure chamber 42 is defined between the large-diameter hole 52 and the second control pin 32. An end surface (annular step part) of the second control pin 32 serves as a pressure receiving surface 32A facing the second pressure chamber 42.

A through hole 58 which is open on the second pressure chamber 42 is formed in the side wall part 50B of the pump housing 50. The pilot pressure is introduced to the second pressure chamber 42 via the through hole 58. The second control pin 32 is moved rightward in FIG. 1 by the pilot pressure received by the pressure receiving surface 32A.

Since a small-diameter part 32B is formed on an end part of the second control pin 32, an opening part of the through hole 58 is not completely closed (see FIG. 2).

The second pressure chamber 42 is connected to a pilot pump via the through hole 58 and a piping. An unillustrated switching valve is disposed in this piping. The switching valve introduces a discharge pressure of the pilot pump as the pilot pressure to the second pressure chamber 42 when the air conditioning device is operated and introduces a tank pressure as the pilot pressure to the second pressure chamber 42 when the operation of the air conditioning device is stopped.

When the load pressures introduced to the first and second pressure chambers 41, 42 respectively increase, the first and second control pins 31, 32 are moved rightward in FIG. 1. Then, a tip part of the second control pin 32 projects from the large-diameter hole 52 in a stepwise manner to drive the swash plate 4 in the direction to reduce the tilting angle via a follower 16 mounted on the swash plate 4 (see FIG. 2).

The swash plate 4 is held at such a tilting angle that the total force of a thrust force of the main control pin, that of the first control pin 31 and that of the second control pin 32 is balanced with the spring forces of the first and second tilt springs 21, 22.

Figure 3A:
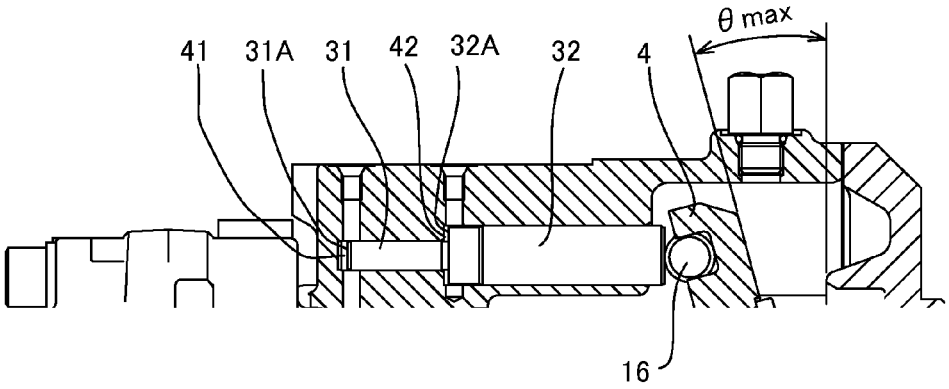
FIG. 3A is a sectional view showing the operation of the piston pump.

FIG. 3A is a sectional view showing a state at a maximum tilt where the tilting angle of the swash plate 4 has a maximum value θmax. At the maximum tilt, the first and second control pins 31, 32 are located at a left side in FIG. 3A.

When the load pressures introduced to the first and second pressure chambers 41, 42 increase, the first and second control pins 31, 32 are moved rightward in FIG. 3A in a stepwise manner to drive the swash plate 4 in the direction to reduce the tilting angle via the follower 16 mounted on the swash plate 4.

Figure 3B:
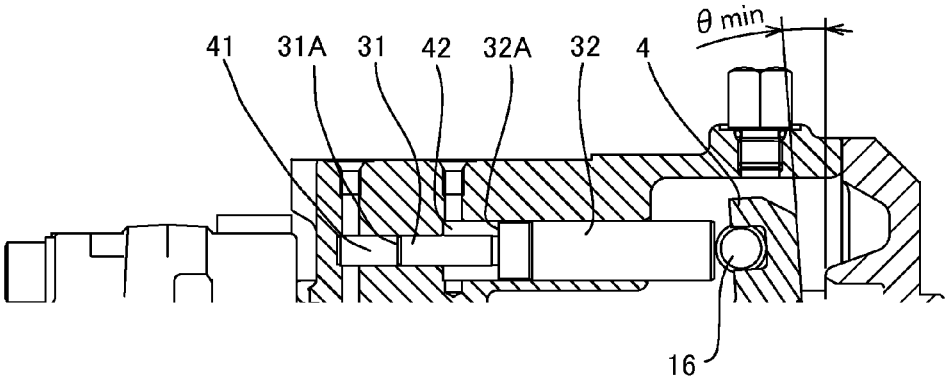
FIG. 3B is a sectional view showing the operation of the piston pump.

FIG. 3B is a sectional view showing a state at a minimum tilt where the tilting angle of the swash plate 4 has a minimum value θmin. At the minimum tilt, the first and second control pins 31, 32 are located at a right side in FIG. 3B.

Figure 4:
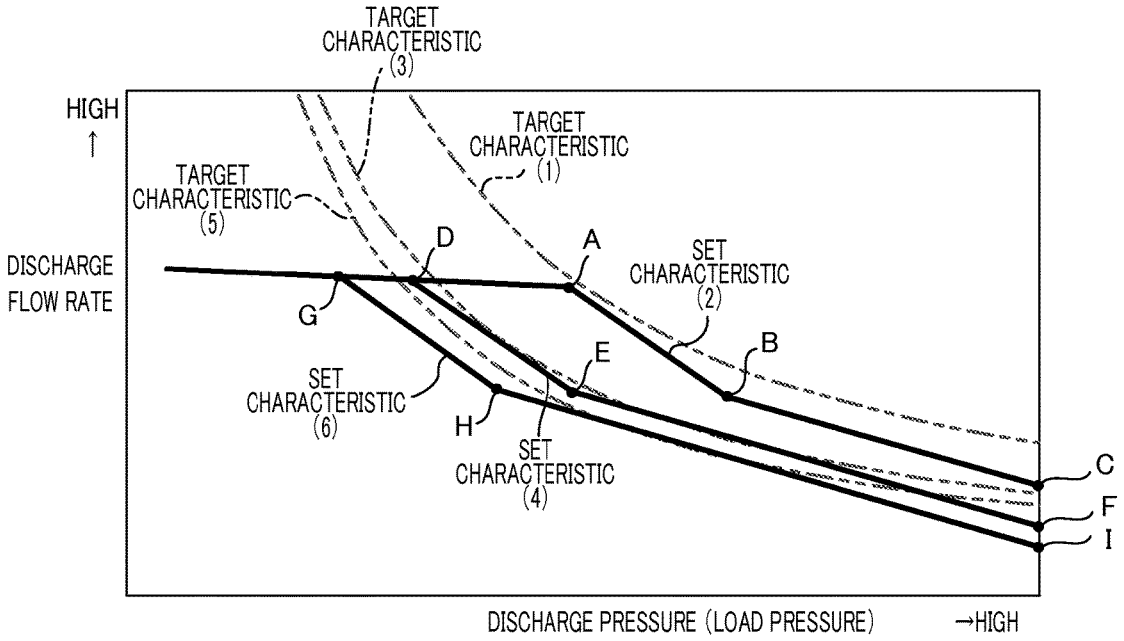
FIG. 4 is a characteristic diagram showing a relationship of a discharge pressure and a discharge flow rate of the piston pump.

FIG. 4 is a characteristic diagram showing a relationship of the discharge pressure (load pressure) and the discharge flow rate (displacement volume) of the piston pump 1.

A target characteristic (1) is a hyperbolic curve in which the output of the engine that drives the main piston pump 1 is a constant value and the product of the discharge pressure and the discharge flow rate of the piston pump 1 is set to be constant. An actual set characteristic (2) is set to be approximate to the target characteristic (1) and composed of a line segment AB and a line segment BC. At a point A, the tilting angle of the swash plate 4 becomes maximum. Between points A and B, the swash plate 4 is compressed only by the first tilt spring 21. Between points B and C, the swash plate 4 is compressed by the both first and second tilt springs 21, 22. Specifically, a characteristic of the line segment AB is specified by the spring force of only the first tilt spring 21. A characteristic of the line segment BC is specified by the total force of the spring forces of the first and second tilt springs 21, 22.

The main control pin that operates according to the discharge pressure of the piston pump 1 tilts the swash plate 4 to a position to be balanced with the spring forces of the first and second tilt springs 21, 22. In this way, power required to drive the piston pump 1 is controlled to be substantially constant.

A target characteristic (3) is a hyperbolic curve in which the output of the engine that drives each of the main piston pump 1 and the sub piston pump 80 is a constant value. The target characteristic (3) is so set that the product of the discharge pressure and the discharge flow rate of the piston pump 1 is reduced by the load of the sub piston pump 80 as compared with the target characteristic (1). An actual set characteristic (4) is set to be approximate to the target characteristic (3) and composed of a line segment DE and a line segment EF. At a point D, the tilting angle of the swash plate 4 becomes maximum. Between points D and E, the swash plate 4 is compressed only by the first tilt spring 21. Between points E and F, the swash plate 4 is compressed by the both first and second tilt springs 21, 22.

The first control pin 31 that operates according to the discharge pressure of the sub piston pump 80 pushes the swash plate 4 via the second control pin 32. The swash plate 4 is tilted to a position to be balanced with the spring forces of the first and second tilt springs 21, 22. In such a set characteristic (4), the main control pin that operates according to the discharge pressure of the main piston pump 1 tilts the swash plate 4 to a position to be balanced with the spring forces of the first and second tilt springs 21, 22 similarly to the set characteristic (2). In this way, the power that drives each of the piston pumps 1 and 80 is controlled to be substantially constant.

A target characteristic (5) is a hyperbolic curve in which the output of the engine that drives each of the main piston pump 1, the sub piston pump 80 and the compressor of the air conditioning device is a constant value. The target characteristic (5) is so set that the product of the discharge pressure and the discharge flow rate of the piston pump 1 is smaller by the total value of the load of the sub piston pump 80 and the load of the compressor of the air conditioning device as compared with the target characteristic (1). An actual set characteristic (6) is set to be approximate to the target characteristic (5) and composed of a line segment GH and a line segment HI. At a point G, the tilting angle of the swash plate 4 becomes maximum. Between points G and H, the swash plate 4 is compressed only by the first tilt spring 21. Between points H and I, the swash plate 4 is compressed by the both first and second tilt springs 21, 22.

The first control pin 31 that operates according to the discharge pressure of the sub piston pump 80 and the second control pin 32 that operates according to the pilot pressure push the swash plate 4. The swash plate 4 tilts to a position to be balanced with the spring forces of the first and second tilt springs 21, 22. In such a set characteristic (6), the main control pin that operates according to the discharge pressure of the main piston pump 1 tilts the swash plate 4 to the position to be balanced with the spring forces of the first and second tilt springs 21, 22 similarly to the set characteristic (2). In this way, the power that drives each of the piston pumps 1 and 80 and the compressor of the air conditioning device is controlled to be substantially constant.

As described above, the discharge capacity of the main piston pump 1 is so adjusted that the consumed power is kept substantially constant even if the loads of the main piston pump 1, the sub piston pump 80 and the compressor provided in the air conditioning device fluctuate.

The gist, functions and effects of the present invention are described below.

The swash plate type piston pump 1 capable of changing the discharge capacity according to the load pressure is provided with the plurality of pistons 8, the cylinder block 3 including the plurality of cylinders 6 for housing the pistons 8, the swash plate 4 for reciprocating the pistons 8 to expand and contract the volume chambers 7 of the cylinders 6 with the rotation of the cylinder block 3, the first and second tilt springs 21, 22 for biasing the swash plate 4 in the direction to increase the tilting angle, the first control pin 31 for driving the swash plate 4 in the direction to reduce the tilting angle according to the discharge pressure of the piston pump 80 and the second control pin 32 for driving the swash plate 4 in the direction to reduce the tilting angle according to the pilot pressure. Further, the first and second control pins 31, 32 are connected in series.

Since this causes the first and second control pins 31, 32 to tilt the swash plate 4 to the position to be balanced with the forces of the first and second tilt springs 21, 22, the power for driving the piston pump 1 is controlled according to the discharge pressure of the piston pump 80 and the pilot pressure. Further, since the first and second control pins 31, 32 are arranged in series, the enlargement of the pump housing 50 due to the space for housing the first and second control pins 31, 32 can be suppressed. This can combine the control of the consumed power of the piston pump 1 according to a plurality of load pressures and the suppression of the enlargement of the piston pump 1.

The swash plate type piston pump 1 includes the casing 2 for housing the cylinder block 3, the pistons 8, the swash plate 4, the first and second tilt springs 21, 22 and the first and second control pins 31, 32. The casing 2 includes the pump housing 50 in which the small-diameter hole 51 into which the first control pin 31 is slidably inserted and the large-diameter hole 52 into which the second control pin 32 is slidably inserted are formed on the same axis, and the pump cover 70 provided with the bearing 13 for tiltably supporting the swash plate 4. The first pressure chamber 41 to which the discharge pressure of the piston pump 80 is introduced is defined between the first control pin 31 and the small-diameter hole 51. The second pressure chamber 42 to which the pilot pressure is introduced is defined between the second control pin 32 and the large-diameter hole 52.

Since this causes the part of the pump housing 50 facing the swash plate 4 to be open before the pump cover 70 is mounted, the small-diameter hole 51 and the large-diameter hole 52 can be respectively formed by machining. Further, since the first and second control pins 31, 32 are respectively housed in the small-diameter hole 51 and the large-diameter hole 52 formed in the pump housing 50, the number of components can be reduced and the enlargement of the piston pump 1 can be suppressed.

It should be noted that although the piston pump 1 has been described as a single-type (1-flow type) pump in which the working fluid pressurized in each volume chamber 7 is discharged from one discharge port, it may be a multiple-type pump in which the working fluid pressurized in each volume chamber is discharged from two or more discharge ports without being limited to this.

The embodiments of the present invention described above are merely illustration of some application examples of the present invention and not of the nature to limit the technical scope of the present invention to the specific constructions of the above embodiments.

The present application claims a priority based on Japanese Patent Application No. 2011-257643 filed with the Japan Patent Office on Nov. 25, 2011, all the contents of which are hereby incorporated by reference.

The invention claimed is:

1. A swash plate pump having a discharge capacity changeable according to a load pressure, the swash plate pump comprising:

a plurality of pistons;

a cylinder block including a plurality of cylinders for housing the pistons;

a swash plate for reciprocating the pistons to expand and contract volume chambers of the cylinders with a rotation of the cylinder block;

a biasing mechanism for biasing the swash plate in a direction to increase a tilting angle of the swash plate;

a first control pin for driving the swash plate in a direction to reduce the tilting angle according to a first load pressure;

a second control pin for driving the swash plate in a direction to reduce the tilting angle according to a second load pressure, the second control pin being connected with the first control pin in series; and a casing for housing the cylinder block, the pistons, the swash plate, the biasing mechanism and the first and second control pins, wherein the casing includes a pump housing in which a small-diameter hole into which the first control pin is slidably inserted and a large-diameter hole which is larger than the small-diameter hole and into which the second control pin is slidably inserted are formed on the same axis, and a pump cover provided with a bearing for tiltably supporting the swash plate, the pump cover being mounted on the pump housing;

a first pressure chamber to which the first load pressure is introduced is defined between the first control pin and the small-diameter hole;

a second pressure chamber to which the second load pressure is introduced is defined between the second control pin and the large-diameter hole;

the small-diameter hole and the large-diameter hole are formed by machining from a side of the pump housing at which the pump cover is mounted before the pump cover is mounted on the pump housing;

the first control pin and the second control pin are inserted into the small-diameter hole and the large-diameter hole, respectively, from the side of the pump housing at which the pump cover is mounted, before the pump cover is mounted on the pump housing; and the first pressure chamber is in fluid communication with a discharge pressure of a sub pump.

2. The swash plate pump according to claim 1, wherein the biasing mechanism comprises a spring mechanism.

3. The swash plate pump according to claim 2, further comprising:

a first retainer mounted in the pump housing; and a second retainer attached to the swash plate, wherein the spring mechanism comprises:

a first coiled tilt spring; and a second coiled tilt spring arranged inside the first tilt spring, wherein the first and second coiled tilt springs are interposed between the first retainer and the second retainer.

4. The swash plate pump according to claim 3, wherein the first tilt spring has a first winding diameter, the second tile spring has a second winding diameter, and the second winding diameter is smaller than the first winding diameter.

5. The swash plate pump according to claim 1, wherein the first pressure chamber communicates with the sub pump via a through hole formed in the pump housing.

6. The swash plate pump according to claim 5, wherein the discharge pressure of the sub pump is introduced to the first pressure chamber via the through hole to move the first control pin.

7. A swash plate pump having a discharge capacity changeable according to a load pressure, the swash plate pump comprising:

a plurality of pistons;

a cylinder block including a plurality of cylinders for housing the pistons;

a swash plate for reciprocating the pistons to expand and contract volume chambers of the cylinders with a rotation of the cylinder block;

a biasing mechanism for biasing the swash plate in a direction to increase a tilting angle of the swash plate;

a first control pin for driving the swash plate in a direction to reduce the tilting angle according to a first load pressure;

a second control pin for driving the swash plate in a direction to reduce the tilting angle according to a second load pressure, the second control pin being connected with the first control pin in series; and a casing for housing the cylinder block, the pistons, the swash plate, the biasing mechanism and the first and second control pins, wherein the casing includes a pump housing in which a small-diameter hole into which the first control pin is slidably inserted and a large-diameter hole which is larger than the small-diameter hole and into which the second control pin is slidably inserted are formed on the same axis, and a pump cover provided with a bearing for tiltably supporting the swash plate, the pump cover being mounted on the pump housing;

a first pressure chamber to which the first load pressure is introduced is defined between the first control pin and the small-diameter hole;

a second pressure chamber to which the second load pressure is introduced is defined between the second control pin and the large-diameter hole; and the small-diameter hole and the large-diameter hole are formed by machining from a side of the pump housing at which the pump cover is mounted before the pump cover is mounted on the pump housing, and wherein:

the pump housing includes a through hole that is open onto the large-diameter hole for introducing the second load pressure to the second pressure chamber;

the second control pin includes a small-diameter part that faces the through hole and that is formed on an end part of the second control pin where the first control pin is connected to the second control pin; and an outer diameter of the small-diameter part is smaller than an outer diameter of another part of the second control pin, said another part continuous to the small-diameter part.

8. A swash plate pump having a discharge capacity changeable according to a load pressure, the swash plate pump comprising:

a plurality of pistons;

a cylinder block including a plurality of cylinders housing the pistons;

a swash plate configured to reciprocate the pistons to expand and contract volume chambers of the cylinders with a rotation of the cylinder block;

a spring biasing the swash plate in a direction to increase a tilting angle of the swash plate;

a first control pin configured to drive the swash plate in a direction to reduce the tilting angle according to a first load pressure;

a second control pin configured to drive the swash plate in a direction to reduce the tilting angle according to a second load pressure, the second control pin being connected with the first control pin in series; and a casing for housing therein the cylinder block, the pistons, the swash plate, the spring and the first and second control pins, wherein the casing includes a pump housing having a small-diameter hole and large-diameter hole, which is larger than the small-diameter hole, hole formed on a same axis, the first control pin slidably inserted into the small-diameter hole, the second control pin slidably inserted into the large-diameter hole, and a pump cover provided with a bearing tiltably supporting the swash plate, the pump cover being mounted on the pump housing;

a first pressure chamber for receiving the first load pressure is defined between the first control pin and the small-diameter hole;

a second pressure chamber for receiving the second load pressure is defined between the second control pin and the large-diameter hole;

along the axis on which the small-diameter hole and the large-diameter hole are formed, the large-diameter hole is arranged between the small-diameter hole and the swash plate, and the swash plate is arranged between the large-diameter hole and the pump cover;

the first control pin and the second control pin are inserted into the small-diameter hole and the large-diameter hole, respectively, from the swash plate side; and the first pressure chamber is in fluid communication with a discharge pressure of a sub pump.

9. The swash plate pump according to claim 8, wherein the small-diameter hole is a blind hole.

10. The swash plate pump according to claim 8, wherein the first pressure chamber communicates with the sub pump via a through hole formed in the pump housing.

11. The swash plate pump according to claim 10, wherein the discharge pressure of the sub pump is introduced to the first pressure chamber via the through hole to move the first control pin.

12. A swash plate pump having a discharge capacity changeable according to a load pressure, the swash plate pump comprising:

a plurality of pistons;

a cylinder block including a plurality of cylinders housing the pistons;

a swash plate configured to reciprocate the pistons to expand and contract volume chambers of the cylinders with a rotation of the cylinder block;

a spring biasing the swash plate in a direction to increase a tilting angle of the swash plate;

a first control pin configured to drive the swash plate in a direction to reduce the tilting angle according to a first load pressure;

a second control pin configured to drive the swash plate in a direction to reduce the tilting angle according to a second load pressure, the second control pin being connected with the first control pin in series; and a casing for housing therein the cylinder block, the pistons, the swash plate, the spring and the first and second control pins, wherein the casing includes a pump housing having a small-diameter hole and a large-diameter hole, which is larger than the small-diameter hole, formed on a same axis, the first control pin slidably inserted into the small-diameter hole, the second control pin slidably inserted into the large-diameter hole, and a pump cover provided with a bearing tiltably supporting the swash plate, the pump cover being mounted on the pump housing;

a first pressure chamber for receiving the first load pressure is defined between the first control pin and the small-diameter hole;

a second pressure chamber for receiving the second load pressure is defined between the second control pin and the large-diameter hole; and along the axis on which the small-diameter hole and the large-diameter hole are formed, the large-diameter hole is arranged between the small-diameter hole and the swash plate, and the swash plate is arranged between the large-diameter hole and the pump cover, and wherein the pump housing includes a through hole that is open onto the large-diameter hole for introducing the second load pressure to the second pressure chamber;

the second control pin includes a small-diameter part that faces the through hole and that is formed on an end part of the second control pin where the first control pin is connected to the second control pin; and an outer diameter of the small-diameter part is smaller than an outer diameter of another part of the second control pin, said another part continuous to the small-diameter part.

* * * * *